US005799504A

United States Patent [19]

Nelson

[11] Patent Number: 5,799,504

[45] Date of Patent: Sep. 1, 1998

[54] REFRIGERATOR SYSTEM WITH FLOAT VALVE FLOW CONTROL

[75] Inventor: William G. Nelson, St. Cloud, Minn.

[73] Assignee: White Consolidated Industries, Inc., Cleveland, Ohio

[21] Appl. No.: 760,048

[22] Filed: Dec. 4, 1996

[51] Int. Cl.[6] ..... F25B 43/00

[52] U.S. Cl. ..... 62/509; 62/474; 137/397

[58] Field of Search ..... 62/474, 509; 137/397, 137/398, 433, 431

[56] References Cited

U.S. PATENT DOCUMENTS

| | | | |
|---|---|---|---|
| 860,396 | 7/1907 | Linn | 137/397 |
| 1,930,296 | 10/1933 | Warneke . | |
| 1,955,702 | 4/1934 | Steenstrup . | |
| 2,019,091 | 10/1935 | Philipp . | |
| 2,082,549 | 6/1937 | Philipp . | |
| 2,191,623 | 2/1940 | Philipp . | |
| 2,403,220 | 7/1946 | Hintze . | |
| 3,103,106 | 9/1963 | Tipton . | |
| 3,399,544 | 9/1968 | Osborne . | |
| 3,681,028 | 8/1972 | Mason | 137/433 X |
| 4,267,702 | 5/1981 | Houk . | |
| 4,304,528 | 12/1981 | Jordan | 137/397 X |
| 4,724,860 | 2/1988 | Kelch | 137/433 X |
| 4,848,098 | 7/1989 | Kuijpers et al. . | |
| 5,038,582 | 8/1991 | Takamatsu | 62/509 X |
| 5,201,190 | 4/1993 | Nelson et al. . | |
| 5,201,340 | 4/1993 | Teepe | 137/397 X |
| 5,205,131 | 4/1993 | Powlas . | |
| 5,385,034 | 1/1995 | Haselden . | |

*Primary Examiner*—Harold Joyce
*Assistant Examiner*—Susanne C. Tinker
*Attorney, Agent, or Firm*—Pearne, Gordon, McCoy and Granger LLP

[57] ABSTRACT

A vapor compression refrigeration system having a condenser, a regulating device, and a capillary tube. The regulating device has a housing defining an inner chamber for receiving refrigerant from the condenser. A float is disposed within the chamber and includes a resilient surface. An outlet line connected to the capillary tube extends through a bottom wall of the housing and into the chamber. The float is movable in response to changes in level of refrigerant in the chamber. The float moves downward to close the outlet line when refrigerant in the chamber drops below a minimum level, and moves upward to open the outlet line when refrigerant in the chamber rises above the minimum level. A filter assembly for removing contaminants from the refrigerant is disposed within the chamber above the float.

32 Claims, 6 Drawing Sheets

REFRIGERATOR SYSTEM WITH FLOAT VALVE FLOW CONTROL

BACKGROUND OF THE INVENTION

This invention relates to vapor compression refrigeration systems and, more particularly, to vapor compression refrigeration systems having flow control valves for controlling the flow of refrigerant between a condenser and a capillary tube.

As is commonly known, vapor compression refrigeration systems are used in refrigerators, freezers, air conditioners and heat pumps. Typically, vapor compression refrigeration systems include a compressor, a condenser, a drier/filter, a flow control device and an evaporator. In vapor compression refrigeration systems, a refrigerant such as R12 is compressed as a vapor in the compressor, cooled to a liquid in the condenser, passed through the flow control device and vaporized in the evaporator. The vaporization of refrigerant draws heat from around the evaporator so as to provide refrigeration.

The flow control device meters liquid refrigerant from the condenser into the evaporator at a rate commensurate with the rate at which vaporization occurs in the evaporator. The flow control device also maintains a pressure differential between high and low pressure sides of the vapor compression refrigeration system in order to permit the refrigerant to vaporize under a desired low pressure in the evaporator, while at the same time condensing at a high pressure in the condenser.

In the prior art, several different types of flow control device are used. One type of flow control device is a controlled expansion valve. A controlled expansion valve typically has a diaphragm or bellows that is movable in response to a signal received from a temperature sensor mounted in, or adjacent to, a condenser. Controlled expansion valves tend to be large and somewhat expensive. Accordingly, controlled expansion valves are typically used in large vapor compression systems.

Another type of flow control device is a float valve. A float valve typically includes a float that is disposed within a chamber and is movable in response to changes in the level of refrigerant in the chamber. Two examples of float valves include U.S. Pat. No. 3,103,106 to Tipton and U.S. Pat. No. 2,191,623 to Philipp, both of which are incorporated herein by reference. Tipton and Philipp each disclose a float valve having an inlet connected to a condenser and an outlet connected to a high side of an evaporator. The outlet is fitted with a valve seat. The float valve includes a housing that defines an inner chamber. The inlet passes through a top wall of the housing, while the outlet passes through a bottom wall of the housing. A float with a needle projecting downward therefrom is movably disposed in the chamber and is aligned with the valve seat. The float moves in accordance with changes in the level of refrigerant in the chamber. When the level of refrigerant is below a certain level, the needle moves into the valve seat and closes the outlet. When the level of refrigerant rises above the certain level, the float rises and the needle moves away from the valve seat, thereby opening the outlet. Such float valves, however, tend to be expensive to manufacture and their valve seats tend to have a relatively short life.

In small vapor compression systems, such as domestic refrigerators, the most common flow control device is a capillary tube. Since the capillary tube has a fixed restriction, the capillary tube is sized for optimal efficiency at a single set of ambient and internal temperatures and pressures. Capillary tubes offer the advantages of low cost, high reliability, and the added efficiency of being easily placed in heat exchange relationship with a return line from the evaporator to the compressor.

Typically, a capillary tube is provided with only a moderate restriction, i.e., is sized relatively "loose", in order to allow fast flooding of the evaporator when the compressor is turned on. The fast flooding of the evaporator allows the vapor compression system to quickly reach a high running efficiency, thereby reducing the amount of time the compressor must run. Once the evaporator is flooded, however, gaseous refrigerant from the condenser often passes through the capillary tube and into the evaporator. This gaseous refrigerant does not provide any refrigeration because it does not go through a phase change. The gaseous refrigerant, however, must still be handled by the compressor. Thus, the compressor becomes loaded with an increased mass flow that does not refrigerate, which is inefficient. In addition, when the compressor is turned off, the pressure across the capillary quickly equalizes, which forms flash gas in the capillary tube and allows hot liquid refrigerant and hot gaseous refrigerant from the condenser to pass into the evaporator. Of course, this adds heat to the evaporator and further decreases the efficiency of the vapor compression system.

Some prior art vapor compression refrigeration systems utilize a regulating device to ameliorate the foregoing adverse effects of a loosely sized capillary tube. Two examples of such prior art vapor compression refrigeration systems having such regulating devices are U.S. Pat. No. 5,201,190 to Nelson et al. and U.S. Pat. No. 5,205,131 to Powlas, both of which are assigned to the assignee of the present invention and both of which are incorporated herein by reference. Both Nelson and Powlas show a subcooling valve having a housing with an inlet connected to a condenser and an outlet connected to a capillary tube. The housing defines a first chamber wherein a bellows apparatus is disposed. The bellows apparatus is filled with non-system refrigerant and is movable in response to changes in the temperature and pressure of system refrigerant entering the subcooling valve. A valve member is connected to the bellows apparatus and is operable to open and close the outlet of the housing in response to movement of the bellows apparatus. When a compressor is running, the subcooling valve opens and closes in a modulating manner to allow only sub-cooled liquid refrigerant to enter the capillary tube. When the compressor stops, the subcooling valve closes to prevent any gaseous refrigerant from entering the capillary tube.

The subcooling valve shown in Nelson and Powlas can be affected by temperature or pressure changes in the subcooling valve that are not caused by temperature or pressure changes in the system refrigerant. In addition, the subcooling valve shown in Nelson and Powlas is a complex device that is relatively expensive to manufacture.

As can be appreciated from the foregoing, there is a need in the art for a vapor compression refrigeration system having a regulating device that ameliorates the adverse effects of a loosely sized capillary tube, is inexpensive to manufacture and is not affected by temperature or pressure. The present invention is directed to such a vapor compression refrigeration system.

SUMMARY OF THE INVENTION

It therefore would be desirable, and is an advantage of the present invention, to provide a refrigeration system having a regulating device that is inexpensive to manufacture and is not affected by temperature or pressure. In accordance with the present invention, the refrigeration system includes an evaporator for vaporizing refrigerant to provide cooling. A compressor is provided for drawing refrigerant from the evaporator, and a condenser is provided for condensing refrigerant from the compressor. A flow control device is provided for maintaining a pressure drop between the condenser and the evaporator. The flow control device has an inlet portion and an outlet portion. The outlet portion is connected to the evaporator.

The regulating device includes a housing, an outlet line, a resilient pad, and a float. The housing defines an inner chamber for receiving refrigerant from the condenser. The housing has a top wall, a side wall and a bottom wall. The top wall defines an inlet passage connected to the condenser, and the bottom wall defines an outlet passage. The outlet line is connected to the inlet portion of the flow control device and extends through the outlet passage. The outlet line includes a valve seat disposed within the chamber. The resilient pad is disposed within the chamber and is aligned above the valve seat. The float is disposed within the chamber and includes the resilient pad at a bottom surface thereof. The float is movable in response to changes in level of refrigerant in the chamber. The float moves the resilient pad downward and into sealing engagement with the valve seat to thereby prevent refrigerant flow into the outlet line when refrigerant in the chamber drops below a minimum level. The float moves the resilient pad upward and out of sealing engagement with the valve seat to thereby permit refrigerant to flow into the outlet line when refrigerant in the chamber rises above the minimum level.

Also provided in accordance with the present invention is a refrigeration system having a regulating device with a plate. The refrigeration system includes an evaporator for vaporizing refrigerant to provide cooling, and a compressor for drawing refrigerant from the evaporator. A condenser is provided for condensing refrigerant from the compressor. The regulating device includes a housing, an outlet line, a closing member, a float, and the plate. The housing defines an inner chamber for receiving refrigerant from the condenser. The housing has a top wall, a side wall and a bottom wall. The top wall defines an inlet passage connected to the condenser, and the bottom wall defines an outlet passage. The outlet line is connected to the evaporator and extends through the outlet passage. The outlet line includes a valve seat. The closing member is disposed within the chamber and is aligned above the valve seat. The float is disposed within the chamber and includes the closing member at a bottom surface thereof. The float is movable in response to changes in level of refrigerant in the chamber. The float moves the closing member downward and into sealing engagement with the valve seat to thereby prevent refrigerant flow into the outlet line when refrigerant in the chamber drops below a minimum level. The float moves the closing member upward and out of sealing engagement with the valve seat to thereby permit refrigerant to flow into the outlet line when refrigerant in the chamber rises above the minimum level. The plate is disposed within the chamber between the top wall and the float. The plate is operable to disperse refrigerant entering the chamber through the inlet passage so as to prevent a concentrated stream of refrigerant from directly impinging upon the float.

Also provided in accordance with the present invention is a refrigeration system having a regulating device with a filter assembly. The refrigeration system includes an evaporator for vaporizing refrigerant to provide cooling, and a compressor for drawing refrigerant from the evaporator. A condenser is provided for condensing refrigerant from the compressor. The regulating device comprises a housing, an outlet line, a closing member, a float, and the filter assembly. The housing defines an inner chamber for receiving refrigerant from the condenser. The housing has a top wall, a side wall and a bottom wall. The top wall defines an inlet passage connected to the condenser, and the bottom wall defines an outlet passage. The outlet line is connected to the evaporator and extends through the outlet passage. The outlet line includes a valve seat disposed within the chamber. The closing member is disposed within the chamber and is aligned above the valve seat. The float is disposed within the chamber and includes the closing member at a bottom surface thereof. The float is movable in response to changes in level of refrigerant in the chamber. The float moves the closing member downward and into sealing engagement with the valve seat to thereby prevent refrigerant flow into the outlet line when refrigerant in the chamber drops below a minimum level. The float moves the closing member upward and out of sealing engagement with the valve seat to thereby permit refrigerant to flow into the outlet line when refrigerant in the chamber rises above the minimum level. The filter assembly is disposed within the chamber between the top wall and the float. The filter assembly is operable to remove contaminants from refrigerant entering the chamber through the inlet passage.

Also provided in accordance with the present invention is a refrigeration system having a float with a resilient surface. The refrigeration system includes an evaporator for vaporizing refrigerant to provide cooling. A compressor is provided for drawing refrigerant from the[]evaporator, and a condenser is provided for condensing refrigerant from the compressor. A flow control device is provided for maintaining a pressure drop between the condenser and the evaporator. The flow control device has an inlet portion and an outlet portion. The outlet portion is connected to the evaporator.

The regulating device includes a housing, an outlet line, and the float. The housing defines an inner chamber for receiving refrigerant from the condenser. The housing has a top wall, a side wall and a bottom wall. The top wall defines an inlet passage connected to the condenser, and the bottom wall defines an outlet passage. The outlet line is connected to the inlet portion of the flow control device and extends through the outlet passage. The outlet line includes a valve seat disposed within the chamber. The float is disposed within the chamber and includes the resilient surface. The float is movable in response to changes in level of refrigerant in the chamber. The float moves downward and into sealing engagement with the valve seat to thereby prevent refrigerant flow into the outlet line when refrigerant in the chamber drops below a minimum level. The float moves upward and out of sealing engagement with the valve seat to thereby permit refrigerant to flow into the outlet line when refrigerant in the chamber rises above the minimum level.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
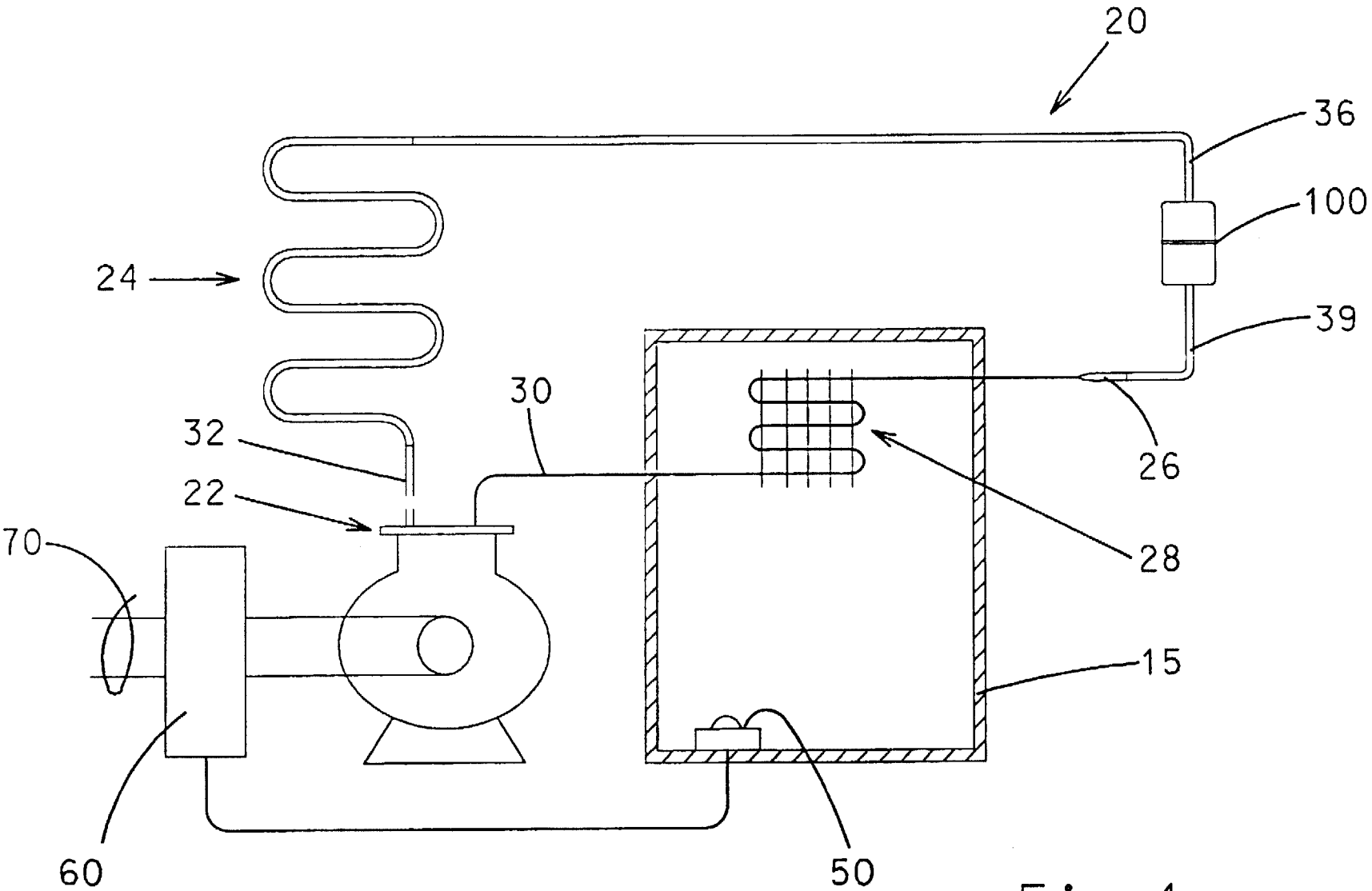
FIG. 1 shows a schematic representation of a refrigeration system having a float valve.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1 there is shown a schematic representation of a vapor compression refrigeration system 20 for a refrigerator. As will be appreciated by one skilled in the art, the refrigeration system 20 can be used in a variety of other applications as well, including air conditioners, ice makers, and heat pumps.

The refrigeration system 20 is a closed recirculating system filled with a suitable refrigerant such as R12 or R134*a*. The vapor compression system generally includes an electric motor-driven compressor 22, a condenser 24, a capillary tube 26, an evaporator 28 and float valve 100 embodied in accordance with the present invention. The evaporator 28 is mounted inside an insulated compartment 15 within the refrigerator, whereas the compressor 22 and the condenser 24 are mounted external to the insulated compartment 15.

The compressor 22 withdraws vaporized refrigerant from the evaporator 28 through a suction line 30 and discharges hot compressed refrigerant to the condenser 24.through a discharge line 32. The compressed refrigerant condenses to a liquid in the condenser 24 and discharges its heat to the outside environment. From the condenser 24, the liquid refrigerant passes through a valve line 36 and then the float valve 100. After the float valve 100, the liquid refrigerant passes through an outlet line 39 and then the capillary tube 26. The capillary tube 26 maintains a pressure drop between the condenser 24 and the evaporator 28. The pressure drop causes the refrigerant to vaporize in the evaporator 28. The vaporization of the refrigerant in the evaporator 28 draws heat from the insulated compartment 15, thereby cooling or refrigerating the insulated compartment 15.

In order to maintain the insulated compartment 15 at a desired temperature, a sensing bulb 50 is mounted within the insulated compartment 15 and is connected to a thermostat 60. The sensing bulb 50 provides a signal representative of the temperature in the insulated compartment 15 to the thermostat 60. The thermostat 60 is provided with contacts (not shown) that control the flow of electricity to the compressor 22 through supply lines 70. When the temperature of the insulated compartment 15 rises to an upper predetermined value, the contacts in the thermostat 60 close to energize the compressor 22. The compressor 22 runs for a length of time until the temperature of the insulated compartment 15 drops to a lower predetermined temperature. The contacts in the thermostat 60 then open and the compressor 22 turns off until the temperature in the insulated compartment 15 again rises to the upper predetermined temperature.

The length of time the compressor 22 runs, i.e., its duty cycle, depends upon numerous factors such as the ambient temperature surrounding the insulated compartment 15, the thermal mass disposed within the insulated compartment 15, and the number of times an access door is opened to allow the admission of warmer outside air. The refrigeration system 20 is sized to so that under most conditions, the compressor 22 will have a duty cycle of approximately fifty percent.

Since the duty cycle of the compressor 22 is approximately fifty percent, the capillary tube 26 is sized "loose", i.e., with a reduced restriction, which allows fast flooding of the evaporator 28 when the compressor 22 is started. Although not shown, the capillary tube 26 is connected so as to be in thermal contact with the suction line 30. The suction line 30 cools the capillary tube 26.

Figure 2:
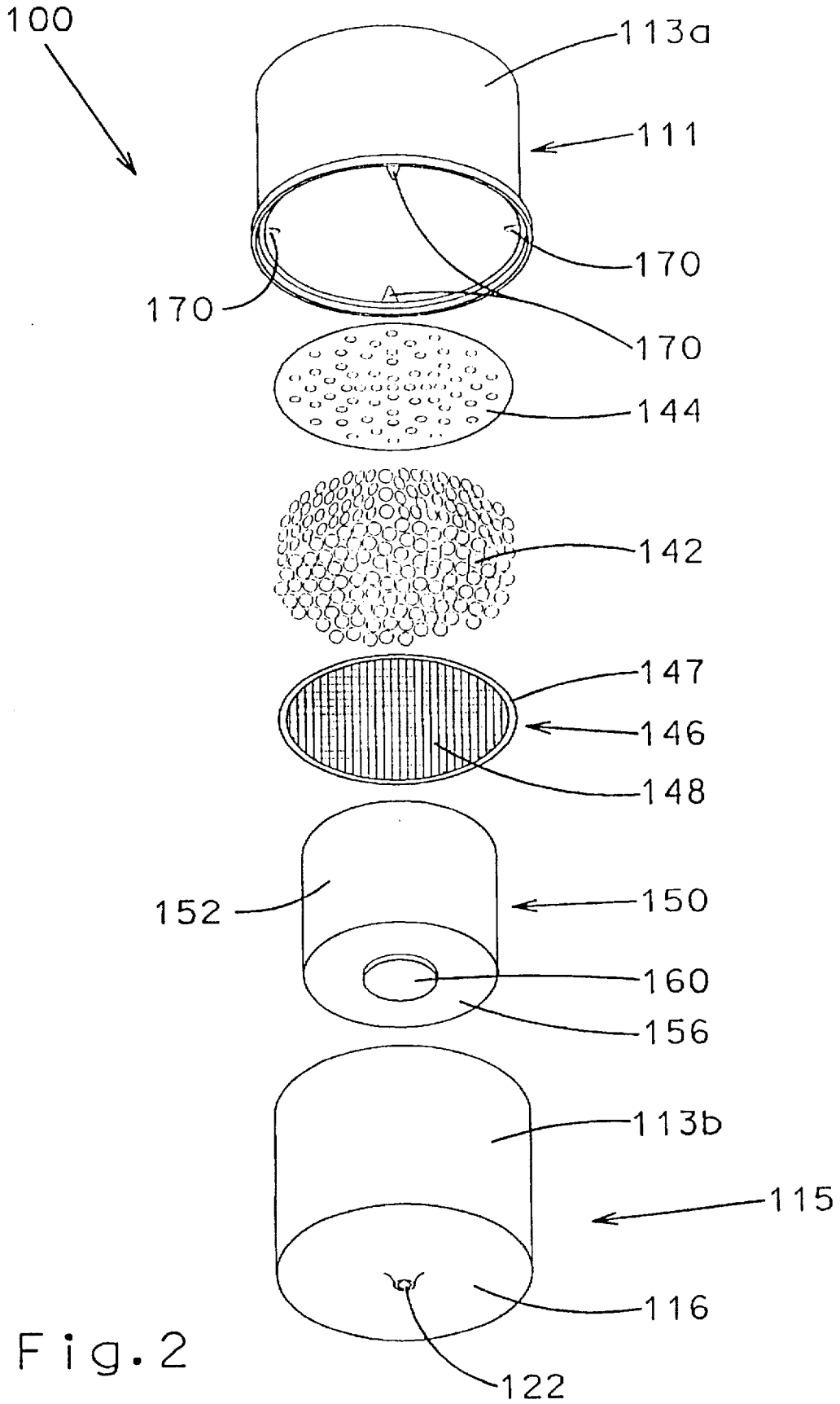
FIG. 2 shows an exploded view of a first embodiment of the float valve.
Figure 3:
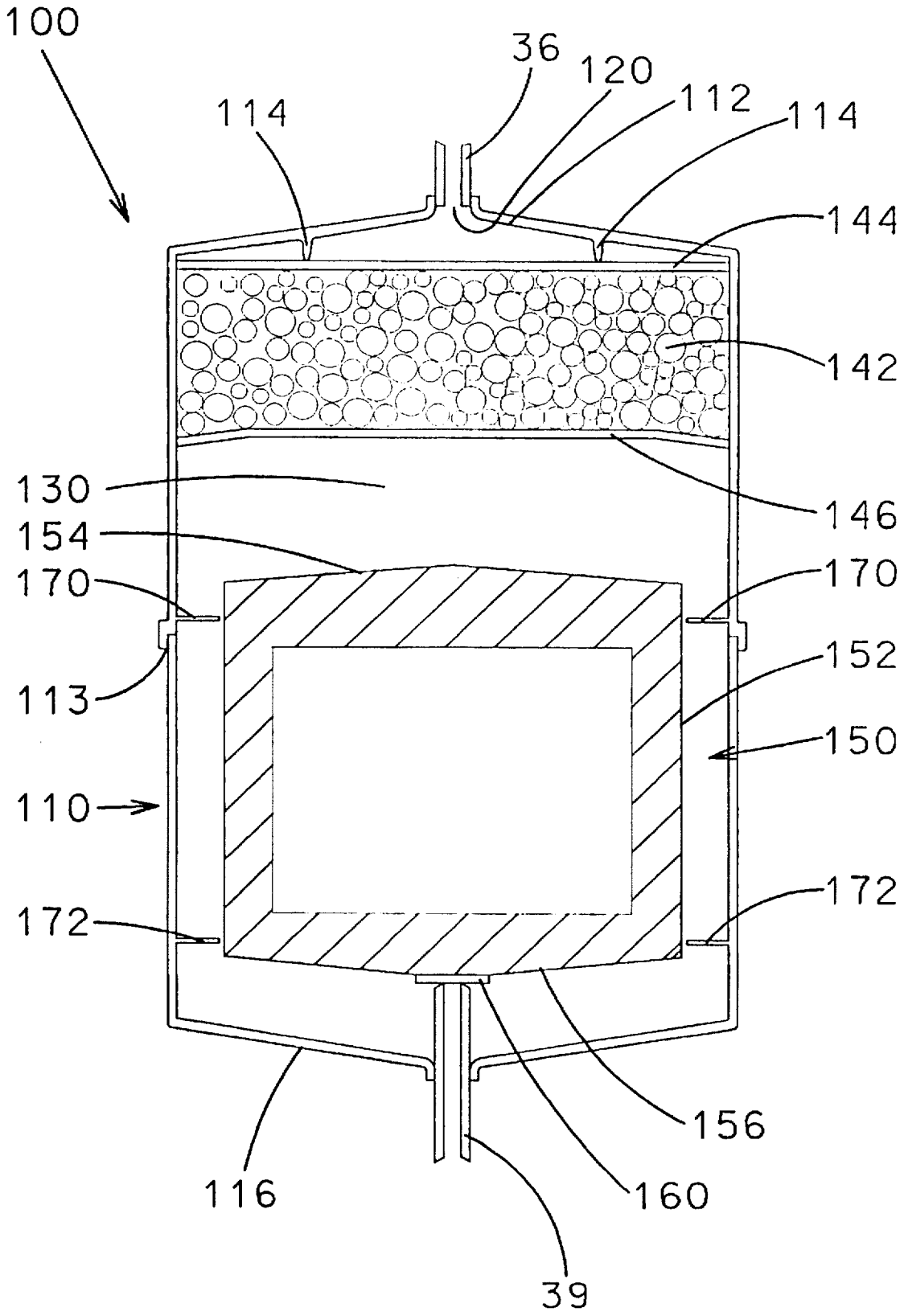
FIG. 3 shows a side sectional view of the first embodiment of the float valve.

Referring now to FIGS. 2 and 3, there is respectively shown an exploded view and a side sectional view of the float valve 100. The float valve 100 includes a generally cylindrical canister 110 and a float 150. The canister 110 defines an inner chamber 130 and is comprised of a top segment 111 and a bottom segment 115. The top and bottom segments 111, 115 are each generally cylindrical and are each composed of a rigid material such as steel or high impact plastic. The top and bottom segments 111, 115 respectively have a top side wall 113*a* and a bottom side wall 113*b* that together form a side wall 113 of the canister 110. The side wall 113 is substantially cylindrical.

The top segment 111 includes the top side wall 113*a*, a top wall 112 and an open bottom end. The top side wall 113*a* has a flared portion at the bottom end. An annular ridge 114 is formed into the top wall 112 and extends downward therefrom. The top wall 112 defines a top opening 120 within which an end of the valve line 36 is securely disposed.

The bottom segment 115 includes the bottom side wall 113*b*, a bottom wall 116 and an open top end. The bottom wall 116 defines a bottom opening 122. A portion of the outlet line 39 is secured within the bottom opening 122. The outlet line 39 extends into the chamber 130 through the bottom opening 122 and terminates at an open interior end spaced above the bottom wall 116.

An upper portion of the bottom side wall 113*b* is disposed within the flared portion of the top side wall 113*a* and is joined thereto by any means that will produce a fluid-tight joint. If the top and bottom segments 111, 115 are composed of metal, the top and bottom segments 111, 115 can be joined together by welding or soldering. If the top and bottom segments 111, 115 are composed of plastic, the top and bottom segments 111, 115 can be joined by heat welding, vibration welding, spin welding, or electromagnetic welding, all of which are well known in the art.

A filter assembly is disposed within the chamber 130 toward the top wall 112 of the canister 110. The filter assembly is comprised of a drier 142 disposed between a dispersal plate 144 and a screen plate 146.

The dispersal plate 144 is disposed adjacent to, but is spaced downward from, the top wall 112 by the ridge 114. The dispersal plate 144 is substantially circular and is sized to have a diameter slightly larger than the diameter of the chamber 130. In this manner, the dispersal plate 144 can be friction fit inside the chamber 130. The dispersal plate 144 is composed of a rigid material such as steel or high impact plastic and has a plurality of perforations formed therein. The perforations permit refrigerant to flow through the dispersal plate 144. The perforations, however, do not allow large particulate contaminants in the refrigerant to pass through the dispersal plate 144. The perforations are spread out over substantially all of the dispersal plate 144 so as to disperse refrigerant flowing downward through the dispersal plate 144. Thus, the dispersal plate 144 both filters and disperses the refrigerant.

The drier 142 is composed of a desiccant material such as synthetically produced crystalline metal alumino-silicates. The drier 142 removes water as well as other contaminants that may be present in the refrigerant. The drier 142 is packed into the chamber 130 below the dispersal plate 144 and is held in place by the screen plate 146.

The screen plate 146 is comprised of a screen 148 surrounded by an outer ring 147. The screen 148 is a very fine steel mesh that will permit refrigerant but not the desiccant material of the drier 142 to flow therethrough. The outer ring 147 is composed of a rigid material such as steel or high impact plastic and is sized to have a diameter slightly larger than the diameter of the chamber 130. In this manner, the screen plate 146 can be friction fit inside the chamber 130.

As shown in FIG. 3, the float 150 is disposed within the chamber 130. The float 150 is generally cylindrical and is sized to have a diameter smaller than the diameter of the chamber 130 so as to be vertically movable in the chamber 130. The float 150 is constructed to be rigid and light in weight. Accordingly, the float 150 can be constructed from wood, plastic, porous ceramic, thin steel, or other type of material. The float 150 includes a substantially cylindrical side wall 152 and top and bottom end walls 154, 156. A pad 160 is secured to the bottom end wall 156. The pad 160 is composed of a resilient material such as rubber. The pad 160 is located substantially in the center of the bottom end wall 156 so as to be aligned above the interior end of the outlet line 39.

A plurality of upper pins 170 and a plurality of lower pins 172 extend radially inward from the-side wall 113 of the canister 110. The upper pins 170 and lower pins 172 terminate at free ends spaced radially outward from the side wall 152 of the float 150. The upper pins 170 are secured to the top side wall **113*a* and are evenly disposed around the circumference thereof. The lower pins 172 are secured to the bottom side wall 113*b* and are evenly disposed around the circumference thereof. The upper and lower pins 170, 172 guide the float 150 inward, away from the side wall 113 so as to prevent the float 150 from adhering to the side wall 113**.

It should be appreciated that the upper and lower pins 170, 172 can be secured to the side wall 152 of the float 150, instead of the top side wall **113*a* and the bottom side wall 113*b* of the canister 110. Moreover, the upper and lower pins 170, 172 can be replaced with annular rings that are formed in the top side wall 113*a* and the bottom side wall 113*b*, and that extend radially inward therefrom. Alternately, the upper and lower pins 170, 172 can be replaced with bumps or ridges that are formed in the side wall 152 of the float 150**.

When the compressor 22 is off, and has not been run for some time, the level of liquid refrigerant in the chamber 130 is below a minimum level. As a result, the float 150 is supported by the interior end of the outlet line 39, with the pad 160 disposed therebetween, as is shown in FIG. 3. The float 150 presses the pad 160 against the interior end, thereby causing the pad 160 to deform around the interior end. Consequently, the pad 160 closes the interior end and prevents any vaporized or liquid refrigerant from traveling through the outlet line 39 to the capillary tube 26. In this manner, the interior end functions as a valve seat and the pad 160 functions as a valve closing member.

When the compressor 22 is started, the compressor 22 pumps residual refrigerant out of the evaporator 28 and into the condenser 24, thereby causing an increase in pressure inside the condenser 24. This increase in pressure causes refrigerant to flow out of the condenser 24 and into the valve line 36. Refrigerant in the valve line 36 flows to the float valve 100 and enters the chamber 130 through the top opening 120.

Refrigerant flows downward from the top opening 120 in a concentrated stream and strikes the dispersal plate 144. The dispersal plate 144 breaks up the concentrated stream and spreads the refrigerant out over substantially all of the dispersal plate 144. Refrigerant flows through the dispersal plate 144 and into the drier 142. Any large particulate contaminants that are present in the refrigerant are deposited on the dispersal plate 144. As refrigerant passes through the drier 142, the drier 142 removes water that may be present in the refrigerant. Other impurities in the refrigerant, such as metal particulates, are also removed by the drier 142. In this manner, the drier 142 filters as well as dries the refrigerant.

From the drier 142, refrigerant passes through the screen plate 146 and flows downward onto the float 150. Refrigerant runs off the float 150 and accumulates at the bottom wall 116. As refrigerant continues to flow into the chamber 130, the level of refrigerant in the chamber 130 rises. When the level of refrigerant rises above the minimum level, which is above the interior end of the outlet line 39, the refrigerant buoys the float 150 upward and lifts the pad 160 off the interior end, thereby opening the outlet line 39. As a result, refrigerant from the chamber 130 flows through the outlet line 39 and travels to the capillary tube 26. Refrigerant flows through the capillary tube 26 and vaporizes in the evaporator 28 to provide refrigeration to the insulated compartment 15.

As the compressor 22 continues running, the temperature of the insulated compartment 15 and the evaporator 28 drops. As a result, the total mass flow of liquid refrigerant in the refrigeration system 20 drops, thereby causing the level of liquid refrigerant in the chamber 130 to drop. However, the float valve 100 will keep the outlet line 39 open as long as liquid refrigerant in the chamber 130 remains above the minimum level. If the level of liquid refrigerant drops below the minimum level, the float valve 100 will close the outlet line 39. Thus, the level of liquid refrigerant in the chamber 130 will always be above the interior end when the float valve 100 opens the outlet line 39. In this manner, the float valve 100 prevents vaporized refrigerant from passing through the float valve 100 to the capillary tube 26.

It should be appreciated that the dispersal plate 144 helps maintain the proper operation of the float valve 100 when the compressor 22 is running and liquid refrigerant is flowing downward into the chamber 130. The dispersal plate 144 disperses the concentrated stream of refrigerant entering the chamber 130. This dispersal prevents the concentrated stream from directly impinging upon the float 150 and forcing the float 150 to move downward. If the float 150 were allowed to be forced downward by the concentrated stream of refrigerant, the pad 160 could close the inlet line 39, when it should otherwise be open.

When the compressor 22 stops running for any reason, such as by operation of the thermostat 60 detecting the lower predetermined temperature in the insulated compartment 15, the compressor 22 stops pumping refrigerant into the condenser 24. As a result, refrigerant substantially stops flowing into the chamber 130 of the float valve 100. However, refrigerant continues to flow out of the chamber 130 because there is still a pressure differential across the capillary tube 26. Thus, the level of refrigerant in the chamber 130 drops. When the level of refrigerant in the chamber 130 drops below the minimum level, the refrigerant no longer buoys the float 150 upward above the interior end, and the float 150 once again presses the pad 160 against the interior end, thereby closing the outlet line 39. With the outlet line 39 closed, vaporized or liquid refrigerant from the condenser 24 cannot enter the capillary tube 26 and the evaporator 28. Since the float valve 100 prevents hot vaporized or liquid refrigerant from entering the evaporator 28 when the compressor 22 is off, the float valve 100 prevents heating of the evaporator 28, and hence the insulated compartment 15, that would otherwise occur if the float valve 100 was not present.

In addition to stopping the flow of hot vaporized or liquid refrigerant to the evaporator, the float valve 100 helps maintain a pressure differential within the refrigeration system 20 when the compressor 22 is off. This pressure differential enables the evaporator 28 to flood quicker when the compressor 22 is restarted. As a result, running conditions are more quickly re-established, thereby decreasing the run time of the compressor 22 for a given amount of cooling.

Figure 4:
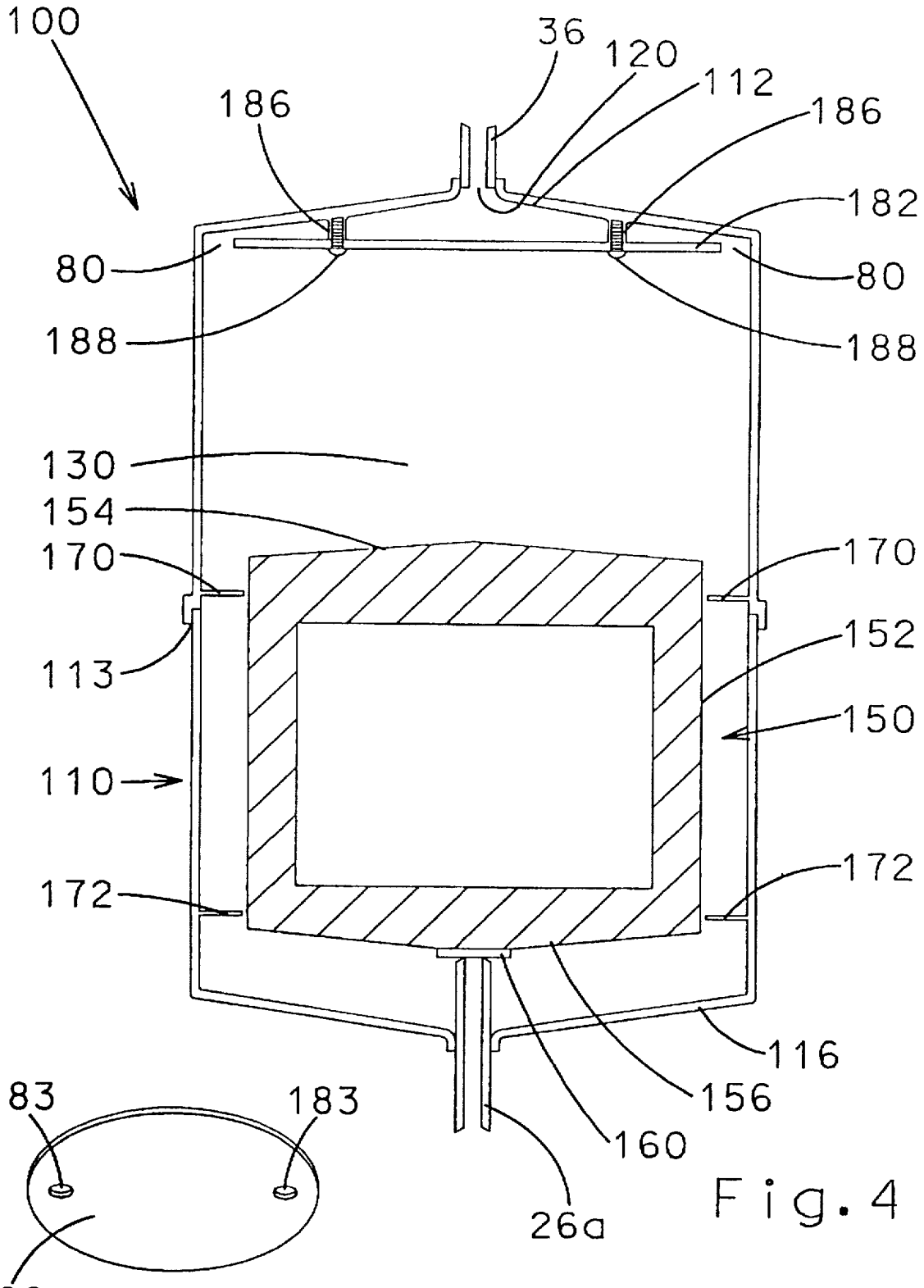
FIG. 4 shows a side sectional view of a second embodiment of the float valve.
Figure 5:
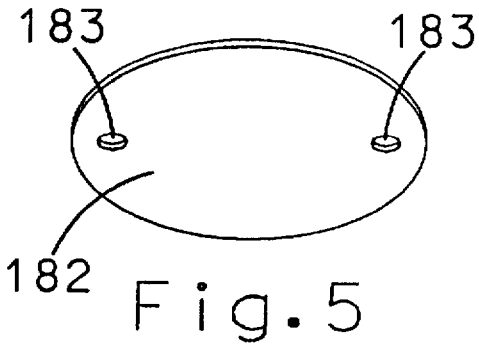
FIG. 5 shows a perspective view of a deflector plate in the second embodiment of the float valve.

Referring now to FIGS. 4, 5 there is shown a second embodiment of the present invention. Specifically, FIG. 4 shows a sectional view of a float valve 180 for use in the refrigeration system 20, and FIG. 5 shows a perspective view of a deflector plate 182 mounted in the float valve 180. The float valve 180 has essentially the same construction as the float valve 100 except for the differences to be hereinafter described. The filter assembly has been removed and has been replaced with the deflector plate 182. Also, the outlet line 39 has been removed and has been replaced with an inlet portion 26*a* of the capillary tube 26. In this manner, an interior end of the inlet portion 26*a* functions as the valve seat. In addition, the top wall 112 of the canister 110 no longer has the ridge 114 formed therein. Instead, the top wall 112 has a pair of downward-extending projections 186 formed therein.

The deflector plate 182 is composed of a rigid material such as steel or high impact plastic and has a pair of holes 183 formed therein. Each of the projections 186 is substantially cylindrical and has a bore extending partially therethrough. The deflector plate 182 is disposed adjacent to the projections 186 such that the holes 183 are aligned with the bores. A pair of screws 188 are threaded through the holes 183 and bores so as to secure the deflector plate 182 to the top wall 112 in a spaced-apart arrangement. The deflector plate 182 is substantially circular and is sized to have a diameter smaller than the diameter of the chamber 130. Thus, an annular gap 80 is formed between the deflector plate 182 and the side wall 113. The deflector plate 182, however, is sized to have a diameter slightly larger than the diameter of the float 150 so the float 150 can be disposed radially inward of the gap 80. In this manner, the deflector plate 182 fully shields the float 150 from above.

When the compressor 22 is running and the concentrated stream of liquid refrigerant is flowing downward into the chamber 130, the deflector plate 182 disperses the concentrated stream and directs the refrigerant toward the annular gap 80. The refrigerant flows through the annular gap 80 and falls toward the bottom wall 116. Most of the refrigerant passes between the float 150 and the side wall 113 as it falls downward. Thus, in addition to dispersing the concentrated stream of refrigerant, the deflector plate 182 also directs the refrigerant away from the float 150. In this manner, the deflector plate 182 substantially prevents refrigerant from directly contacting the float 150.

Figure 6:
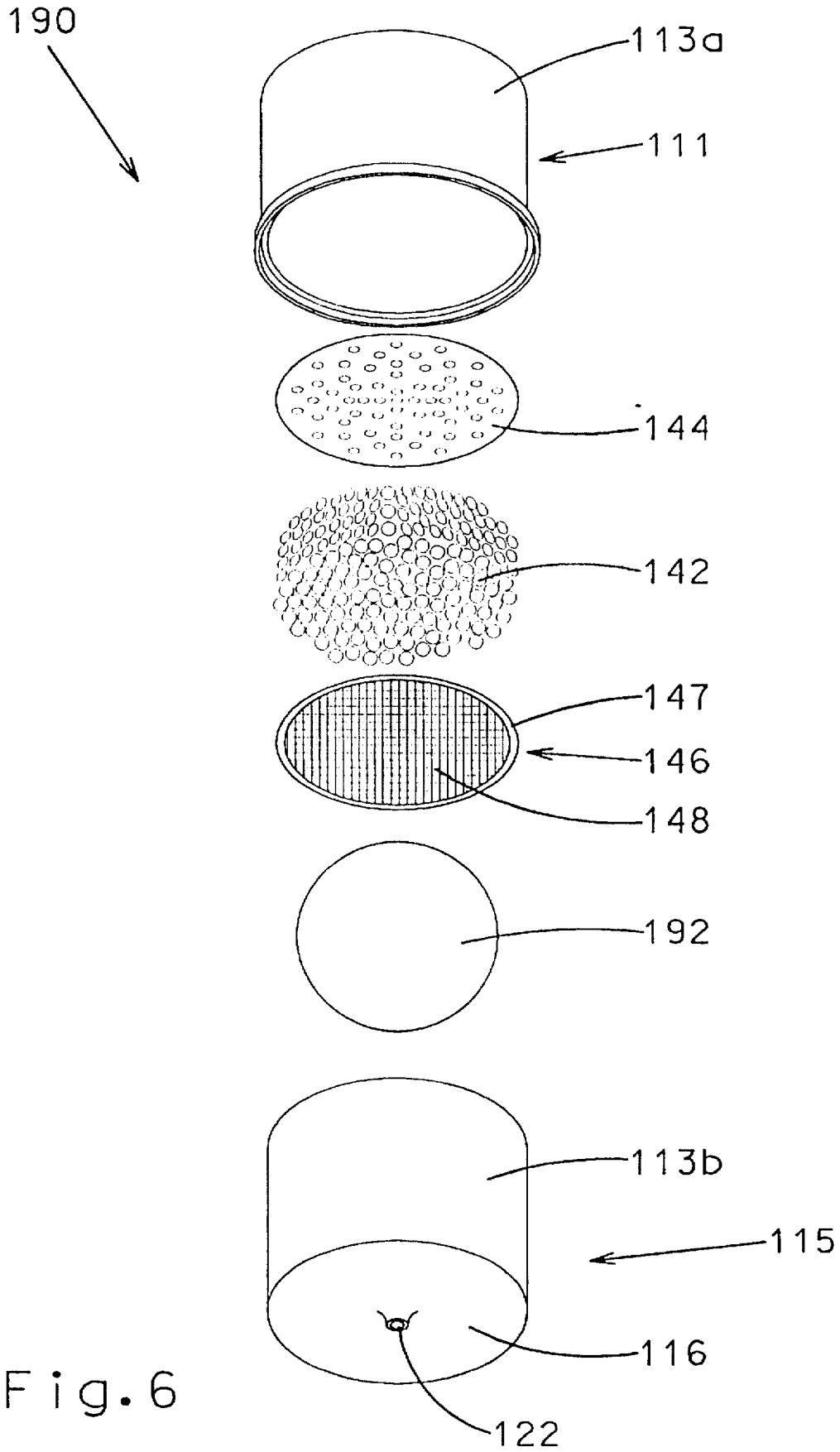
FIG. 6 shows an exploded view of a third embodiment of the float valve.
Figure 7:
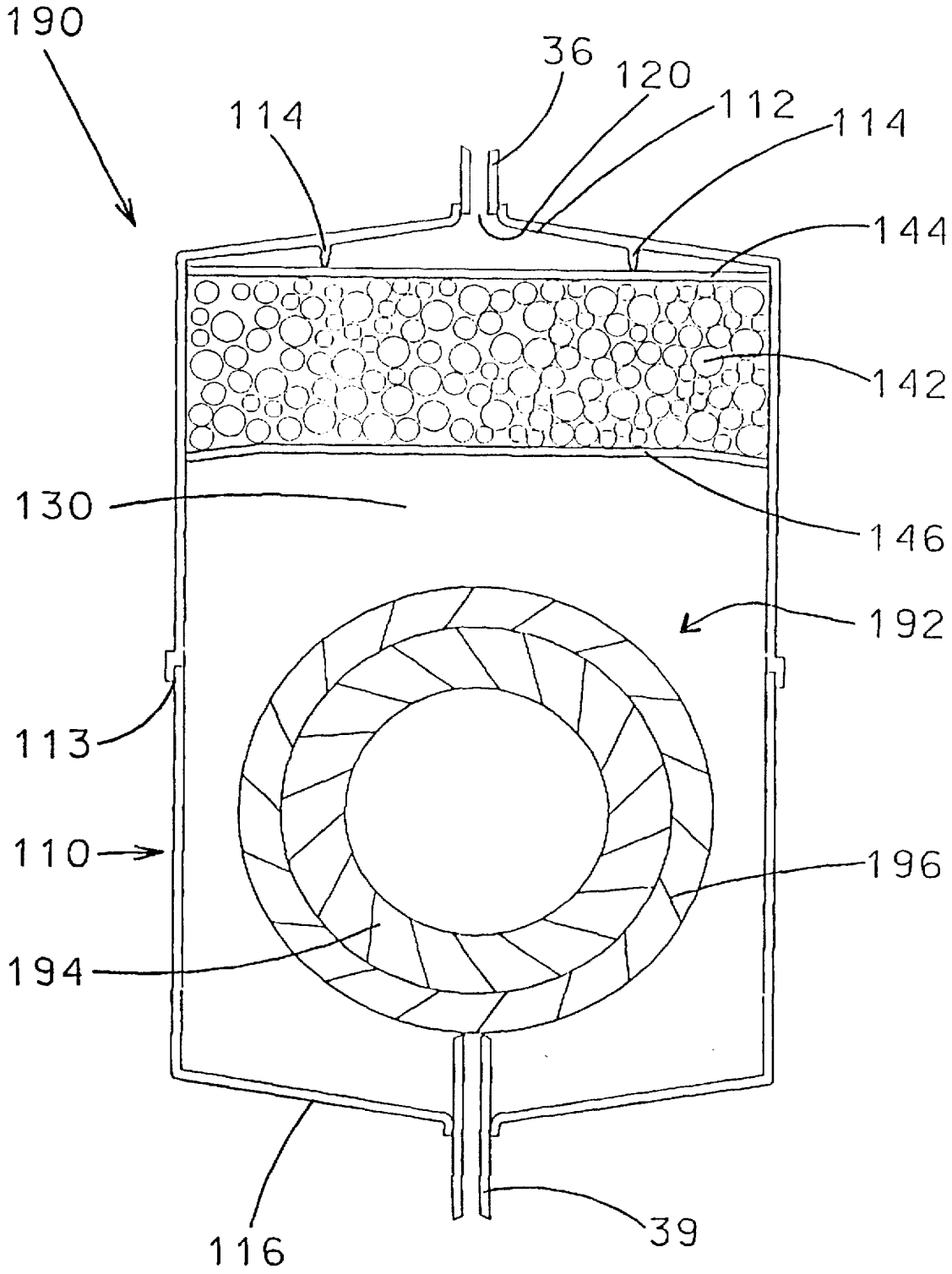
FIG. 7 shows a side sectional view of the third embodiment of the float valve.

Referring now to FIGS. 6, 7 there is shown a third embodiment of the present invention. Specifically, FIG. 6 shows an exploded view of a float valve 190 for use in the refrigeration system 20, and FIG. 7 shows a side sectional view of the float valve 190. The float valve 190 has essentially the same construction as the float valve 100 except for the differences to be hereinafter described. The float 150 has been removed and has been replaced with a float 192. In addition, the upper pins 170 and the lower pins 172 have been removed.

As shown in FIG. 7, the float 192 is disposed in the chamber 130. The float 192 is generally spherical and is sized to have a diameter smaller than the diameter of the chamber 130 so as to be vertically movable in the chamber 130. As best shown in FIG. 7, the float 192 has an inner core 194 and an outer shell 196. The inner core 194 is constructed to be rigid and light in weight. Accordingly, the inner core 194 can be composed of wood, plastic, porous ceramic, thin steel, or other type of material. The inner core 194 can be solid or hollow. The outer shell 196 completely covers the inner core 194 and is composed of a resilient material such as rubber.

The float 192 operates in a manner similar to the float 150. When the compressor 22 is off, and has not been run for some time, the level of liquid refrigerant in the chamber 130 is below a minimum level. As a result, the float 192 rests on the interior end of the outlet line 39 as is shown in FIG. 7. The weight of the float 192 presses the outer shell 196 against the interior end, thereby causing the outer shell 196 to deform around the interior end. Consequently, the outer shell 196 closes the interior end and prevents any vaporized or liquid refrigerant from traveling through the outlet line 39 to the capillary tube 26. In this manner, the outer shell 196 functions as the valve closing member.

When the compressor 22 is started, liquid refrigerant flows from the condenser 24, through the valve line 36 and enters the chamber 130 through the top opening 120. When the level of refrigerant rises above the minimum level, the refrigerant buoys the float 192 upward and lifts the outer shell 196 off the interior end of the outlet line 39, thereby opening the outlet line 39. As, a result, refrigerant from the chamber 130 flows through the outlet line 39 and travels to the capillary tube 26.

When the compressor 22 stops running for any reason, the level of refrigerant in the chamber 130 drops. When the level of refrigerant in the chamber 130 drops below the minimum level, the refrigerant no longer buoys the float 192 upward above the interior end, and the outer shell 196 once again is pressed against the interior end, thereby closing the outlet line 39. With the outlet line 39 closed, vaporized or liquid refrigerant from the condenser 24 cannot enter the capillary tube 26 and the evaporator 28.

It should be appreciated that the generally spherical shape of the float 192 greatly decreases the amount of surface area of the float 192 that can contact the side wall 113 of the canister 110 at any one time. This reduction in surface area greatly reduces the amount of friction that develops between the float 192 and the side wall 13, and which impedes vertical movement of the float 192. Consequently, the need to guide the float 192 inward, away from the side wall 13, is eliminated, thereby permitting the upper pins 170 and the lower pins 172 to be removed from the canister 110.

The generally spherical shape of the float 192 permits the float 192 to rotate within the chamber 130. The rotation of the float 192, however, does not affect the operation of the float 192 because any portion of the outer shell 196 can close the interior end of the outlet line 39.

Although the preferred embodiments of this invention have been shown and described, it should be understood that various modifications and rearrangements of the parts may be resorted to without departing from the scope of the invention as disclosed and claimed herein. For example, the canister 110 can be provided with a generally elliptical shape or a generally rectangular shape instead of a generally cylindrical shape. In the float valve 100 and the float valve 190, the outlet line 39 can be eliminated and the capillary tube 26 brought directly into the chamber 130 through the bottom opening 122, as is shown for the float valve 180.

I claim:

1. A refrigeration system comprising:

an evaporator for vaporizing refrigerant to provide cooling;

a compressor for drawing refrigerant from the evaporator;

a condenser for condensing refrigerant from the compressor;

a flow control device for maintaining a pressure drop between the condenser and the evaporator, said flow control device having an inlet portion and an outlet portion, said outlet portion being connected to the evaporator;

a regulating device comprising:

a housing defining an inner chamber for receiving refrigerant from the condenser, said housing having a top wall, a side wall and a bottom wall, said top wall defining an inlet passage connected to the condenser, and said bottom wall defining an outlet passage;

an outlet line connected to the inlet portion of the flow control device and extending through the outlet passage, said outlet line including a valve seat disposed within the chamber;

a resilient and generally planar pad disposed within the chamber and aligned above the valve seat; and a float disposed within the chamber and having a generally planar bottom surface, said resilient pad secured directly to said bottom surface, said float being movable in response to changes in level of refrigerant in the chamber, said float moving the resilient pad downward and into sealing engagement with the valve seat to thereby prevent refrigerant flow into the outlet line when refrigerant in the chamber drops below a minimum level, and moving the resilient pad upward and out of sealing engagement with the valve seat to thereby permit refrigerant to flow into the outlet line when refrigerant in the chamber rises above the minimum level.

2. The refrigeration system of claim 1 further comprising a filter assembly disposed within the chamber between the top wall and the float, said filter assembly being operable to remove contaminants from refrigerant entering the chamber through the inlet passage.

3. The refrigeration system of claim 1 further comprising a plate disposed within the chamber between the top wall and the float, said plate being operable to disperse refrigerant entering the chamber through the inlet passage so as to prevent a concentrated stream of refrigerant from directly impinging upon the float.

4. The refrigeration system of claim 3 wherein the side wall of the housing is substantially cylindrical, and wherein the plate is substantially circular.

5. The refrigeration system of claim 4 wherein the plate adjoins the side wall of the housing and defines a plurality of perforations for permitting refrigerant to flow through the plate.

6. The refrigeration system of claim 5 further comprising:

a screen disposed within the chamber between the plate and the float; and a desiccant material disposed within the chamber between the screen and the plate, said desiccant material removing water and other impurities from refrigerant entering the chamber through the inlet passage.

7. The refrigeration system of claim 4 wherein the plate is spaced inward from the side wall of the housing so as to form an annular gap therebetween, said plate directing refrigerant into the gap.

8. The refrigeration system of claim 7 wherein the float is disposed radially inward of the gap so that refrigerant flowing through the gap substantially avoids contacting the float.

9. The refrigeration system of claim 1 wherein the flow control device is a capillary tube.

10. The refrigeration system of claim 1 wherein the resilient pad is composed of rubber.

11. A refrigeration system comprising:

an evaporator for vaporizing refrigerant to provide cooling;

a compressor for drawing refrigerant from the evaporator;

a condenser for condensing refrigerant from the compressor;

a flow control device for maintaining a pressure drop between the condenser and the evaporator, said flow control device having an inlet portion and an outlet portion, said outlet portion being connected to the evaporator; and a regulating device comprising:

a housing defining an inner chamber for receiving refrigerant from the condenser, said housing having a too wall, a side wall and a bottom wall, said top wall defining an inlet passage connected to the condenser, said bottom wall defining an outlet passage, and said side wall being substantially cylindrical;

an outlet line connected to the inlet portion of the flow control device and extending through the outlet passage, said outlet line including a valve seat disposed within the chamber;

a resilient pad disposed within the chamber and aligned above the valve seat;

a float disposed within the chamber and including the resilient pad at a bottom surface thereof, said float being movable in response to changes in level of refrigerant in the chamber, said float moving the resilient pad downward and into sealing engagement with the valve seat to thereby prevent refrigerant flow into the outlet line when refrigerant in the chamber drops below a minimum level, and moving the resilient pad upward and out of sealing engagement with the valve seat to thereby permit refrigerant to flow into the outlet line when refrigerant in the chamber rises above the minimum level; and a plate disposed within the chamber between the top wall and the float, said plate being operable to disperse refrigerant entering the chamber through the inlet passage so as to prevent a concentrated stream of refrigerant from directly impinging upon the float, said plate being substantially circular; and a plurality of pins extending radially inward from the side wall of the housing and terminating at free ends spaced radially outward from the float, said pins guiding the float as the float moves up and down within the chamber.

12. A refrigeration system comprising:

an evaporator for vaporizing refrigerant to provide cooling;

a compressor for drawing refrigerant from the evaporator;

a condenser for condensing refrigerant from the compressor; and a regulating device comprising:

a housing defining an inner chamber for receiving refrigerant from the condenser, said housing having a top wall, a side wall and a bottom wall, said top wall defining an inlet passage connected to the condenser, and said bottom wall defining an outlet passage;

an outlet line connected to the evaporator and extending through the outlet passage, said outlet line including a valve seat disposed within the chamber;

a closing member disposed within the chamber and aligned above the valve seat;

a float disposed within the chamber and including the closing member at a bottom surface thereof, said float being movable in response to changes in level of refrigerant in the chamber, said float moving the closing member downward and into sealing engagement with the valve seat to thereby prevent refrigerant flow into the outlet line when refrigerant in the chamber drops below a minimum level, and moving the closing member upward and out of sealing engagement with the valve seat to thereby permit refrigerant to flow into the outlet line when refrigerant in the chamber rises above the minimum level; and a plate disposed within the chamber between the top wall and the float and located adjacent said inlet passage, said plate being operable to disperse refrigerant entering the chamber through the inlet passage so as to prevent a concentrated stream of refrigerant from directly impinging upon the float.

13. The refrigeration system of claim 12 further comprising a flow control device for maintaining a pressure drop between the condenser and the evaporator, said flow control device having an inlet portion and an outlet portion, said outlet portion being connected to the evaporator.

14. The refrigeration system of claim 13 wherein the flow control device is a capillary tube.

15. The refrigeration system of claim 13 wherein the outlet line is comprised of the inlet portion of the flow control device.

16. The refrigeration system of claim 13 wherein the outlet line is connected to the inlet portion of the flow control device.

17. The refrigeration system of claim 12 wherein said plate is secured to at least one of said side wall and said top wall of said housing.

18. the refrigeration system of claim 17 wherein said plate is secured to said side wall of said housing with a friction fit.

19. The refrigeration system of claim 12 wherein the plate is contiguous with the side wall of the housing and defines a plurality of perforations for permitting refrigerant, and not particulates suspended therein, to flow through the plate.

20. The refrigeration system of claim 19 further comprising a screen disposed within the chamber between the plate and the float and a desiccant material disposed within the chamber between the screen and the plate, said desiccant material removing water and other impurities from refrigerant entering the chamber through the inlet passage.

21. A refrigeration system comprising:

an evaporator for vaporizing refrigerant to provide cooling;

a compressor for drawing refrigerant from the evaporator;

a condenser for condensing refrigerant from the compressor;

a regulating device comprising:

a housing defining an inner chamber for receiving refrigerant from the condenser, said housing having a top wall, a side wall and a bottom wall, said top wall defining an inlet passage connected to the condenser, and said bottom wall defining an outlet passage, side wall of the housing being substantially cylindrical;

an outlet line connected to the evaporator and extending through the outlet passage, said outlet line including a valve seat disposed within the chamber;

a closing member disposed within the chamber and aligned above the valve seat;

a float disposed within the chamber and including the closing member at a bottom surface thereof, said float being movable in response to changes in level of refrigerant in the chamber, said float moving the closing member downward and into sealing engagement with the valve seat to thereby prevent refrigerant flow into the outlet line when refrigerant in the chamber drops below a minimum level, and moving the closing member upward and out of sealing engagement with the valve seat to thereby permit refrigerant to flow into the outlet line when refrigerant in the chamber rises above the minimum level; and a plate disposed within the chamber between the top wall and the float, said plate being operable to disperse refrigerant entering the chamber through the inlet passage so as to prevent a concentrated stream of refrigerant from directly impinging upon the float, and wherein the plate is contiguous with the side wall of the housing and defines a plurality of perforations for permitting refrigerant, and not particulates suspended therein, to flow through the plate.

22. The refrigeration system of claim 21 wherein the closing member is comprised of a rubber pad.

23. The refrigeration system of claim 21 further comprising a screen disposed within the chamber between the plate and the float and a desiccant material disposed within the chamber between the screen and the plate, said desiccant material removing water and other impurities from refrigerant entering the chamber through the inlet passage.

24. A refrigeration system comprising:

an evaporator for vaporizing refrigerant to provide cooling;

a compressor for drawing refrigerant from the evaporator;

a condenser for condensing refrigerant from the compressor;

a regulating device comprising:

a housing defining an inner chamber for receiving refrigerant from the condenser, said housing having a top wall, a side wall and a bottom wall, said top wall defining an inlet passage connected to the condenser, and said bottom wall defining an outlet passage;

an outlet line connected to the evaporator and extending through the outlet passage, said outlet line including a valve seat disposed within the chamber;

a closing member disposed within the chamber and aligned above the valve seat;

a float disposed within the chamber and including the closing member at a bottom surface thereof, said float being movable in response to changes in level of refrigerant in the chamber, said float moving the closing member downward and into sealing engagement with the valve seat to thereby prevent refrigerant flow into the outlet line when refrigerant in the chamber drops below a minimum level, and moving the closing member upward and out of sealing engagement with the valve seat to thereby permit refrigerant to flow into the outlet line when refrigerant in the chamber rises above the minimum level; and a filter assembly disposed within the chamber between the top wall and the float, said filter assembly being operable to remove contaminants from refrigerant entering the chamber through the inlet passage.

25. The refrigeration system of claim 24 further comprising a capillary tube for maintaining a pressure drop between the condenser and the evaporator, said capillary tube having an inlet portion and an outlet portion, said outlet portion being connected to the evaporator.

26. The refrigeration system of claim 25 wherein the outlet line is connected to the inlet portion of the capillary tube.

27. The refrigeration system of claim 24 wherein the side wall of the housing is substantially cylindrical; and wherein the filter assembly comprises a substantially circular plate adjoining the side wall of the housing and spaced below the top wall, said plate defining a plurality of perforations for permitting refrigerant, and not particulates suspended therein, to flow through the plate.

28. The refrigeration system of claim 27 wherein the filter assembly further comprises:

a screen spaced above the float; and a desiccant material disposed between the screen and the plate, said desiccant material removing water and other impurities from refrigerant entering the chamber through the inlet passage.

29. A refrigeration system comprising:

an evaporator for vaporizing refrigerant to provide cooling;

a compressor for drawing refrigerant from the evaporator;

a condenser for condensing refrigerant from the compressor;

a flow control device for maintaining a pressure drop between the condenser and the evaporator, said flow control device having an inlet portion and an outlet portion, said outlet portion being connected to the evaporator;

a regulating device comprising:

a housing defining an inner chamber for receiving refrigerant from the condenser, said housing having a top wall, a side wall and a bottom wall, said top wall defining an inlet passage connected to the condenser, and said bottom wall defining an outlet passage;

an outlet line connected to the inlet portion of the flow control device and extending through the outlet passage, said outlet line including a valve seat disposed within the chamber; and a float disposed within the chamber, said float having a resilient surface and being movable in response to changes in level of refrigerant in the chamber, said float moving downward and into sealing engagement with the valve seat to thereby prevent refrigerant flow into the outlet line when refrigerant in the chamber drops below a minimum level, and moving upward and out of sealing engagement with the valve seat to thereby permit refrigerant to flow into the outlet line when refrigerant in the chamber rises above the minimum level.

30. The refrigeration system of claim 29 wherein the float further comprises an inner core covered by an outer shell, said outer shell comprising the resilient surface.

31. The refrigeration system of claim 30 wherein the float is substantially spherical.

32. The refrigeration system of claim 30 wherein the outer shell is composed of rubber.

* * * * *

UNITED STATES PATENT AND TRADEMARK OFFICE

CERTIFICATE OF CORRECTION

PATENT NO. : 5,799,504

DATED : September 1, 1998

INVENTOR(S) : William G. Nelson

It is certified that error appears in the above-identified patent and that said Letters Patent is hereby corrected as shown below:

Column 4, Line 32, delete "the[]evaporator" and insert --the evaporator--.

Column 5, Line 42, delete "24.through" and insert --24 through--.

Column 7, Line 41, delete "the-side" and insert --the side--.

Column 12, Line 39, Claim 11, delete "too" and insert --top--.

Signed and Sealed this

Fifteenth Day of December, 1998

Bruce Lehman

*Attest:*

BRUCE LEHMAN

*Attesting Officer*

*Commissioner of Patents and Trademarks*